United States Patent [19]

Morin

[11] Patent Number: 4,680,093

[45] Date of Patent: Jul. 14, 1987

[54] METAL BONDED COMPOSITES AND PROCESS

[75] Inventor: Louis G. Morin, Tarrytown, N.Y.

[73] Assignee: American Cyanamid Company, Stamford, Conn.

[21] Appl. No.: 507,603

[22] Filed: Jun. 24, 1983

Related U.S. Application Data

[63] Continuation-in-part of Ser. No. 358,637, Mar. 16, 1982.

[51] Int. Cl.[4] ..... C25D 7/00

[52] U.S. Cl. ..... 204/28

[58] Field of Search ..... 204/23, 27, 28, 20, 204/38.5

[56] References Cited

U.S. PATENT DOCUMENTS 3,550,247 12/1970 Evans et al. ..... 29/419
3,622,283 11/1971 Sara ..... 29/183.5
3,677,705 7/1972 Ram et al. ..... 23/209.1
4,115,322 9/1978 Morcos ..... 502/101

OTHER PUBLICATIONS

De LaMotte, E., et al., "Continuously Cast Aluminum-Carbon Fiber Composites and Their Tensile Properties" J. Mater. Sci. 7(1972) 346-349.

*Primary Examiner*—T. M. Tufariello
*Attorney, Agent, or Firm*—Michael J. Kelly

[57] ABSTRACT

Metal base composites are provided by electro-depositing on conductive core filaments a thin, firmly-adherent, uniform layer of a metal, the bond strength between the core and the deposited metal being such that when the unbonded coated filament is bent, as in knitting and weaving, the coating may fracture, but it will not peel off. The filaments are together, preferably in a substantially parallel aligned manner, with a metal or metal alloy matrix.

16 Claims, 2 Drawing Figures

METAL BONDED COMPOSITES AND PROCESS

CROSS REFERENCE

This application is a continuation-in-part of the earlier filed copending application Ser. No. 358,637, filed Mar. 16, 1982.

The present invention relates to metal coated filament-metal bonded composites made up of a plurality of filaments electroplated with a firmly bonded metallic layer and thereafter bonded together, preferably in a substantially side-by-side or parallel manner, by means of a metal matrix.

BACKGROUND OF THE INVENTION

Filaments of semimetals such as carbon, boron, silicon carbide, and natural and synthetic polymers, such as cotton, rayon, wool, nylon, polyesters, aramids, and the like, in the form of yarns, mats, cloths and chopped strands, woven, knitted, unidirectional, and other engineered fabric structures are known to be useful in reinforcing metals and plastics. Articles comprising matrix metals reinforced with such filaments are finding widespread use in replacing heavier components made from lower strength conventional materials such as aluminum, steel, titanium, lead, tin, zinc, alloys thereof, and the like in aircraft, aerospace, automobiles, office equipment, sporting goods, etc., and in many other fields.

A common problem in the use of such filaments is a seeming lack of ability to translate the properties of the high strength filaments to the matrix metal to which ultimate and intimate contact is to be made.

The problem is manifested in a variety of ways: for example, if lengths of high strength carbon fiber yarn are enclosed lengthwise in the center of rods formed from solidified molten lead, zinc, or tin, and the rods are pulled until broken, the breaking strengths will be less than those expected from the rule of mixtures, and greater than those of rods formed, respectively, from lead, zinc or tin alone, due to merely mechanical entrapment of the fibers. The lack of reinforcement is entirely due to poor translation of strength between the fibers and the matrix metal. Other fibers, such as rayon fibers in low melting metal matrixes also suffer from such shortcomings.

In R. V. Sara, U.S. Pat. No. 3,622,283, it has been reported that this problem can be overcome by first coating the filaments, e.g., carbon filaments, with a thin, e.g., 1 to 3 microns thick, and continuous metallic film or coupling agent, e.g., nickel, which has a melting point greater than that of the matrix metal, e.g., a tin alloy, and is also readily wetted by the matrix metal. More specifically, short lengths, 4 inch or so, of carbon filaments were clamped in a battery clip, immersed in an electrolyte and nickel plated. Then plated filaments were cut into 1 inch lengths and manually loaded into a perforated tube and vacuum infiltrated with molten tin, then permitted to cool. Not only is such a composite difficult to characterize physically, but also it is of limited use in the production of a wide range of useful workpieces.

Methods for producing metal composites are also described in Evans et al, U.S. Pat. No. 3,550,247, which subjects carbon filaments to an oxidizing treatment under strong oxidizing conditions, e.g., with concentrated nitric acid or chromic acid before coating them with metal e.g., nickel and dispersing them in a matrix of the same, or different metal, e.g., nickel, chromium, aluminum, copper, or lead. The strong oxidizing conditions, however, may be responsible for the observation by others of higher strengths in unplated filament reinforced composites than in plated filament reinforced composites.

In applicant's earlier filed copending application, Ser. No. 358,637, filed Mar. 16, 1982, it is disclosed that, if a very high order of external voltage is applied during electroplating, by special techniques, uniform, continuous, adherent thin, metal coatings can be provided to reinforcing filaments, especially carbon filaments. Coating thickness of 0.25 to 0.75 microns can be achieved. If a core material having a boundary layer, is used, such as carbon filaments, high voltage is used to provide energy to uniformly nucleate the metal ion on the surface, and through the boundary layer. On the other hand, if an electrically conductive core, free of boundary layer, is used, such as roughened aramid fiber chemically plated with adherent silver, then the high voltage is needed to uniformly nucleate the filaments, especially the innermost filaments in bundles or tows of the filaments. Filaments comprising the thin metal coatings or yarns, woven cloths, and the like, according to the procedure disclosed, can be knotted and folded without the metal substantially flaking off.

Articles made by adding metal coated filaments of the above-mentioned copending invention to a metal matrix forming material distinguish those from the prior art, including the above-mentioned U.S. Pat. No. 3,622,283, and U.S. Pat. No. 3,550,247 because they are very strongly reinforced, showing tensile strengths much closer to those which would be predicted from the rule of mixtures.

SUMMARY OF THE INVENTION

According to the present invention, there are provided articles comprising metal coated filaments, the core-to-metal bond strength being sufficient to provide that, when the coated filament is bent sharply the coating may fracture, but it will not peel off. The metal coated filaments are further bonded together, preferably in a substantially parallel, aligned manner, with a metal or metal alloy matrix. Such composites are generally provided by a process which comprises:

(a) providing a plurality of electrically conductive core filaments;

(b) immersing at least a portion of the length of said filaments in a solution capable of electrolytically depositing at least one metal;

(c) providing a quantity of electricity and applying an external voltage between the filaments and an electrode immersed in the solution, which voltage is in excess of that which is normally required to cause metal deposition whereby (i) the metal nucleates substantially uniformly onto the surface of the filaments and (ii) there is produced a substantially uniform, firmly adherent layer of metal on said core; and (d) building up a metal matrix around the metal coated fibers to form a composite material.

Preferably the process comprises shaping an aggregate of the metal coated fibers into the desired form, infiltrating the voids between the individual fibers with molten matrix metal or alloy and cooling the resultant metal infiltrated aggregate to produce a composite article. Other known techniques can also be used, e.g., mixing the fibers with powdered matrix metal and isostatically pressing the mixture into a composite. Preferably, the core is semimetallic, e.g., carbon, graphite, boron or silicon carbide, or non-metallic, rough and covered with a firmly bonded electrically-conductive interlayer of a chemically deposited metal, e.g., a wool, cotton, silk or rayon core or a mechanically roughened polyester, nylon or aramid core, sensitized with palladium, and on which silver has been deposited by reduction with hydrazine, or obvious chemical equivalents.

DESCRIPTION OF THE DRAWING

The invention will be better understood by reference to the drawing, in which.

DETAILED DESCRIPTION OF THE INVENTION

Figure 1:
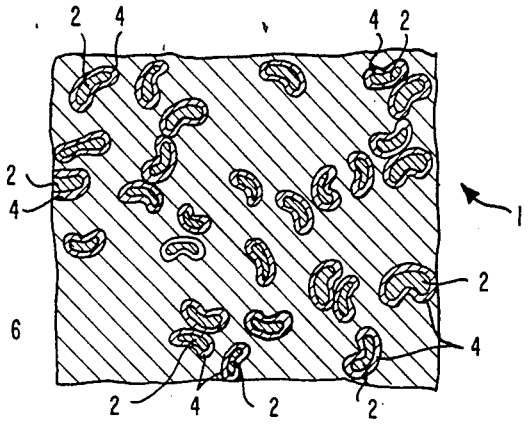
FIG. 1 is a diagrammatic illustration of a rectangular section of a carbon filament-metal matrix composite article produced according to the teachings of the instant invention.

Referring now in detail to FIG. 1, there is shown in cross section a rectangular composite article 1 consisting of substantially filaments 2 which may comprise carbon, silicon carbide, cotton, wool, silk, aramid, and the like having disposed on their surface a continuous 0.25 to 0.75, perferably 0.5 micron, thick coating of electrodeposited metal 4. Non-conductive filaments will be provided with a conventional metal interlayer (not shown) of sufficient thickness to make them electrically conductive. If desirable the interlayer is applied after abrading the surface of the core e.g., with a fluidized bed abrader. The metal will be preferably crystalline and can be selected from nickel, silver, zinc, copper, lead, cadmium, tin, cobalt, gold, indium, iron, palladium, platinum, tellurium, or a mixture or alloy of any of the foregoing, e.g., brass, etc. It is contemplated in some features to use more than one such layer (not shown), e.g., nickel first, then brass. These so-coated fibers are bonded together by matrix metal 6, which can have a solubility rate above or below that of the metal coating 4, and can comprise any conventional matrix metal, illustratively and, without limitation, aluminum, lead, zinc, silver, gold, magnesium, tin, iron, titanium or a mixture or alloy of any of the foregoing, e.g., tin alloyed with lead, antimony and/or bismuth carbon steel, nickel alloys, etc. In any event, matrix metal 6 must not dissolve all of the electroplated coating to retain intimate gas free bond. Therefore, plated coating is chosen for limited solubility, when used alone, limited time at melt or, undesirable plated layer to matrix interface alloy, or structure.

Filaments for use in the core 2 according to the present invention are available from a number of sources commercially. For example, suitable carbon filament yarns are available from Hercules Company, Celanese Great Lakes Carbon, Union Carbide Company and similar sources in the United States, and overseas. All are made, in general, by procedures described in U.S. Pat. No. 3,677, 705. Cotton threads are also available. Aramid fibers are available from DuPont Company under the trademark KEVLAR. The filaments can be short, e.g., from 0.003 inches nominal to long and continuous. As mentioned above, all such carbon filaments will contain a thin, imperfect boundary layer (not shown) of chemically bonded oxygen and chemically or mechanically bonded other materials, such as organics.

Non-conductive core filaments can be used, if an additional processing step is used, i.e., to make them amenable in known ways, to the electrodeposition of the ultimate metal coating layer. One preferred means is to deposit a conductive metal interlayer on the core fiber. To insure that the interlayer is firmly adherent, it is essential that the surface of the core filament is rough, either naturally rough, e.g., cotton, wool, silk and the like, or roughened, e.g., by mechanical abrasion, chemical etching, heat-treatment and the like. The interlayer can be deposited in known ways, but it is preferred to do it by chemical deposition onto the sensitized surface of the rough core. Sensitization can be accomplished in a number of ways, it is convenient to immerse or treat the core with an aqueous solution of stannous chloride or stannous sulfate, and then with a solution of a noble metal salt, e.g., platinum or palladium, gold rhodium, etc., in the form of halides or obvious chemical equivalents. This activates the surface and then immersion in a chemical deposition solution or solutions, e.g., silver nitrate followed by hydrazine, causes metal, e.g., silver to deposit as a metal layer. When this layer sufficiently increases in thickness to render the core electrically conductive (an ohmmeter can determine this) then the final metal coating layer or layers can be deposited by electrodeposition.

Formation of the metal coating layer by the electrodeposition process used in this invention can be carried out in a number of ways. For example, a plurality of conductive core filaments can be immersed in an electrolytic bath and through suitable electrical connections the high external voltage can be applied. Because the filaments are so small, e.g., 5 to 10 microns in diameter, and because the innermost filaments are usually surrounded by hundreds or even thousands of others (even though only 0.5 to 2.6 volts are needed to dissociate the electrolytic metal ions, e.g., nickel, gold, silver, copper) depending on the salt used, massive amounts of external voltage are needed, of the order of five times the dissociation values, to uniformly nucleate the ions through the bundle of fibers into the innermost filament and then through the boundary layer. Preferably, external voltages of, e.g., 10 to 50, or even more, volts are used.

Figure 2:
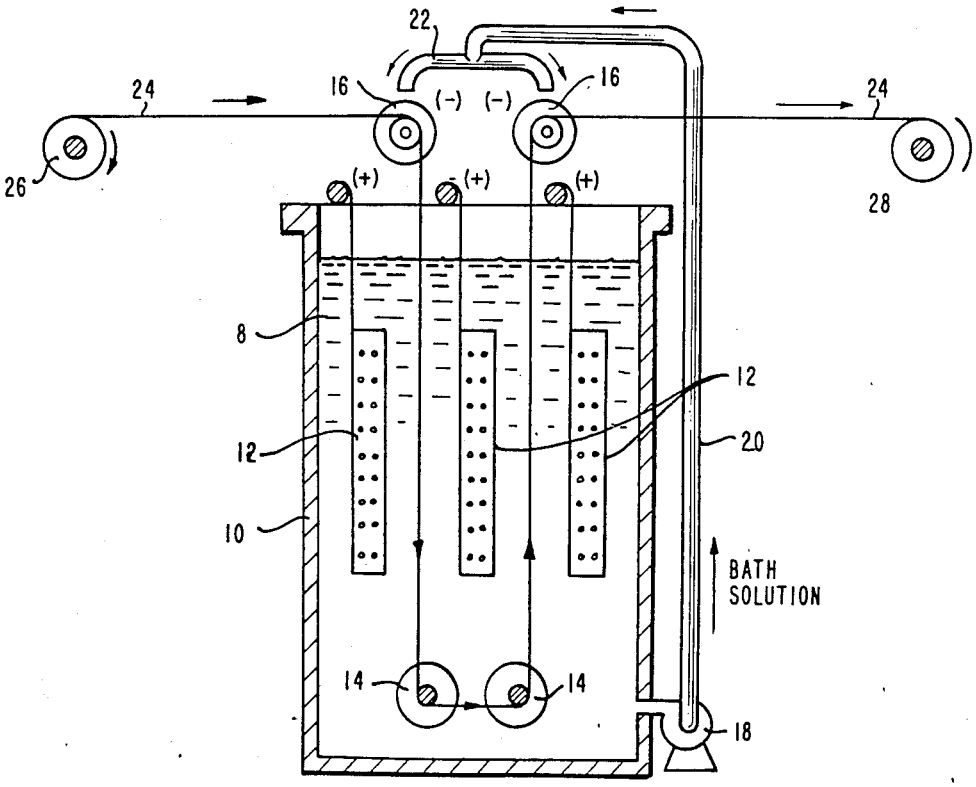
FIG. 2 is a view showing an apparatus for producing the electroplated fibers employed in making the metal matrix composites of the present invention.

Although other methods can be used, it is preferred to carry out the procedure in a continuous fashion on a moving tow or plurality of filaments. To overcome the problem of filament burnout because of high voltages, to keep them cool enough outside the bath, one can separate the filaments and cool them, for example, but it is preferred to operate in an apparatus shown schematically in FIG. 2. Electrolytic bath solution 8 is maintained in tank 10. Also included are anode baskets 12 and idler rollers 14 near the bottom of tank 10. Two electrical contact rollers 16 are located above the tank. Tow 24 is pulled by means not shown off feed rollers 26, over first contact rollers 16 down into the bath under idler rollers 16 and into take up rollers 28. Optional, but very much preferred, is a simple loop comprising pump 18, conduit 20, and feed head 22. This permits recirculating the plating solution at a large flow rate, and pumping it onto contact rollers 16. Discharged just above the rollers, the sections of tow 24 entering and leaving the solution are totally bathed, thus cooling them. At the high current carried by the tows, the heat generated in some cases might destroy them before they reach or after they leave the bath surface without such cooling. Of course, more than one plating bath can be used in series, and the filaments can be rinsed free of electrolyte solution, treated with other conventional materials and dried, chopped, woven into fabrics, all in accordance with conventional procedures.

Referring again to FIG. 1, filaments 2 can be of any length, e.g., from ⅛th inch to continuous lengths and they are shown to be disposed in the metal matrix in a substantially parallel or side-by-side manner, the length dimension of filaments 2 being perpendicular to the surface of the drawing. On the other hand, the filaments can be laid up into non-woven mats, or knitted and woven into fabrics before being infiltrated with the matrix metal to produce other conventional forms of composites (not shown).

To make the composite, any method, such as the methods described in U.S. Pat. No. 3,550,247, can be used, substituting the metal clad filaments used herein. For example, the matrix can be built up around the filaments by electroforming. It can be built up aound the coated fibers by powder technology techniques, casting, simple immersion, casting, etc. The amount of coated filaments in the matrix will vary widely, but in general, conventional amounts will be present.

Physical properties can then be measured on the specimen, including density, modulus of elasticity and tensile strength. Compared to the matrix metal, the density will be less, and the modulus of elasticity and tensile and yield strength will be greater, and electrical properties are greatly enhanced as a function of specific gravity.

DESCRIPTION OF THE PREFERRED EMBODIMENTS

The following Examples illustrate the present invention, but are not intended to limit it.

EXAMPLE 1

In a continuous electroplating system, a bath is provided having the following composition:

| INGREDIENT | AMOUNT |
|---|---|
| nickel sulfate ($NiSO_4.6H_2O$) | 40 ounces/gallon |
| nickel chloride ($NiCl_2.6H_2O$) | 12–20 ounces/gallon |
| boric acid ($H_3BO_3$) | 5–8 ounces/gallon |
| wetting agent (WA-129, State Chemical) | 2% by volume |
| brightener (saccharin) | 1–3% by volume |

The bath is heated to 140–160° F. and has a pH of 3.8–4.2.

The anode baskets are kept filled with electrolytic nickel pellets and 4 tows (fiber bundles) of 12,000 strands each of 7 micron carbon fibers are continuously drawn through the bath while an external voltage of 30 volts is applied at a current adjusted to give 5 amperes-minutes per 1,000 strands total. At the same time, electrolytic solution is recycled through a loop into contact with the entering and leaving parts of the tow. The tow is next passed continously through an identical bath, at a tow speed of 5.0 ft./min. with 180 amps. current as in the first bath. The final product is a tow of high strength coated fibers comprising a 7 micron fiber core and about 50% by weight of crystalline electrodeposited nickel adhered firmly to the core, the coating layer being approximately 0.5 microns thick. The density is in the range of 2.5–3.0 g./cm$^3$. The tensile strength is up to 450,000 psi. The tensile modulus is about 34 million psi. Electrical resistance is about 0.10 ohms/1000 strands/cm.

If a length of the fiber is sharply bent, then examined, there is no circumferential cracking on the metal coating in the tension side of the bend. The tow can be twisted and knotted without causing the coating to flake or come off as a powder. If a section of the coating is mechanically stripped from the fibrils, there will be a perfect reverse image down to and including a replica of the fibril construction of the fiber.

The long, nickel coated graphite yarns are pultruded at a high rate with molten lead in an apparatus from which a ⅛" diameter rod issues in solidified form, down through which runs an even dispersion of the nickel coated graphite fibers. The lead is alloyed to the nickel without complete solvency of the nickel and the nickel is well bonded to the graphite fibrils. This results in a translation of the physical strength of the graphite fibers through the nickel plating, nickel/lead interface to the lead matrix. A section of the rod is pulled in an apparatus to measure breaking strength. In comparison with a lead rod of the same diameter, the breaking strength of the matrix containing nickel coated graphite fibers of this invention is very much higher. In a test, a 0.143 in. diameter rod containing 40K fiber metal coated according to this invention in a pure lead matrix metal had a tensile of 91,000 psi and a modulus of 8,600,000 psi. In another test a 0.15 in. diameter rod with 6×12K fiber metal-coated according to this invention in a 63/37 tin-lead alloy matrix had a tensile strength of 76,000 psi, and a modulus of 7,000,000 psi, and a strain of 1.6%. In other tests with composites according to this invention, the yield strength was nearly the same as the tensile strength.

EXAMPLE 2

The procedure of Example 1 can be modified by substituting for the second nickel bath a bath of the following composition, using standard 80% Cu/20% zinc anodes, and nickel plated brass coated graphite fibers will be obtained:

| INGREDIENT | AMOUNT |
|---|---|
| Copper Cyanide | 4 ounce/gallon |
| Zinc cyanide | 1.25 ounce/gallon |
| Sodium cyanide | 7.5 ounce/gallon |
| Sodium carbonate | 4 ounce/gallon |

This bath is run at 110–120° F. and about 24 volts. Following two water rinses, the nickel/brass plated fibers are washed with a solution of sodium dichromate, to prevent tarnishing, and then rinsed twice again with water.

Bundles of the nickel/brass coated graphite fibers are dipped into molten zinc for up to two minutes at 2 feet per minute. In a #4 crucible, 10 seconds is ample. The brass acts as a diffusion rate moderator. There is produced a high strength pultruded zinc matrix which can't be pulled apart or broken, and its density is much less than that of zinc. If brass is not used as a diffusion adsorbing layer, the molten zinc will instantaneously dissolve the nickel and a good conposite will not be obtained. Zinc on nickel will act as a moderator when aluminum is the matrix metal.

The foregoing patents and publications are incorporated herein by reference. Many variations of the present invention will suggest themselves to those skilled in this art in light of the above detailed description. For example, aluminum, silver, gold and magnesium can be used as matrix metals with brass/coated nickel coated graphite fibers. Silicon carbide and boron can be substituted for carbon fibers. Iron can be plated on graphite and copper can be used as the matrix metal. For the carbon fibers, the following can be substituted: cotton thread, wool yarn, aramid filaments (Du Pont Co. KEVLAR 29, surface roughened with a water slurry of 320 mesh silica in a gas fluidized mechanical abrader), after first having deposited a metallic interlayer of silver on the stannous chloride-palladium chloride sensitized core. The silver layer can be deposited from a silver nitrate solution with 85% hydrazine hydrate, allowing it to build up until resistance, measured by an ohmmeter, is lowered to the point where electrical conductivity permits the final metal coating to be deposited electrolytically. Instead of molten metal, metal powders can be mixed with the fibers and the composite formed by isostatic pressing. In one aspect, the metal coating can be sacrificed, e.g., by solution in hot matrix metal to produce a form of composite in which the matrix is in direct contact with the core. Such composites are useful, but do not have many of the superior characteristics provided by the other embodiments of the invention. All such variations are within the full intended scope of the appended claims.

What is claimed is:

1. A process for the production of a metal composite, said process comprising:

(a) providing a plurality of electrically conductive core filaments;

(b) immersing at least a portion of the length of said filaments in a solution capable of electrolytically depositing at least one metal;

(c) providing a quantity of electricity and applying an external voltage between the filaments and an electrode immersed in the solution in excess of 10 volts whereby (i) the metal nucleates substantially uniformly onto the surface of the filaments and (ii) there is produced a substantially uniform, firmly adherent, continuous layer of metal on said core; and (d) building up a metal matrix around the metal coated fibers to form a composite material.

2. A process as defined in claim 1 wherein the metal matrix is built up around the coated filaments by powder technology techniques, casting or pultrusion.

3. A process as defined in claim 1 wherein the metal matrix comprises aluminum, lead, zinc, silver, gold, magnesium, tin or a mixture of any of the foregoing.

4. A process as defined in claim 3 wherein the metal matrix comprises lead.

5. A process as defined in claim 3 wherein the metal matrix comprises zinc.

6. A process as defined in claim 1 wherein the electrodeposited metal comprises nickel, silver, zinc, copper, lead, arsenic, cadmium, tin, cobalt, gold, indium, iridium, iron, palladium, platinum, tellurium, tungsten, or a mixture of any of the foregoing.

7. A process as defined in claim 6 wherein the electrodeposited metal is nickel.

8. A process as defined in claim 6 wherein the electrodeposited metal is in two layers, the innermost comprising nickel and the outermost comprising brass.

9. A process as defined in claim 1 wherein the core comprises carbon, boron, silicon carbide, cotton, wool, a polyester, a nylon or an aramid.

10. A process as defined in claim 9 wherein the core comprises carbon in the form of graphite.

11. A process as defined in claim 1 wherein step (d) is carried out under conditions leading to substantially complete sacrifice of the metal coating, thereby producing a composite material in which the matrix metal is in contact with the core fiber.

12. A composite produced by the process of claim 11.

13. A process as defined in claim 6 wherein the electrodeposited metal is in two layers.

14. A process as defined in claim 1 wherein said external voltage is in excess of about 24 volts.

15. A process as defined in claim 1 wherein said external voltage is in excess of about 30 volts.

16. A process for the production of a metal composite, said process comprising:

(a) providing a continuous length of a plurality of electrically conductive core filaments;

(b) continously immersing at least a portion of the length of said filaments in a solution capable of electrolytically depositing at least one metal;

(c) providing a quantity of electricity and applying an external voltage between the filaments and an electrode immersed in the solution in excess of 10 volts whereby (i) the metal nucleates substantially uniformly onto the surface of the filaments and (ii) there is provided a substantially uniform, firmly adherent, continous layer of metal on said core; and (d) building up a metal matrix around the metal coated fibers to form a composite material.

* * * * *